United States Patent [19]

Scholta

[11] 4,289,225

[45] Sep. 15, 1981

[54] AIR COMPRESSOR AND DISPENSER

[75] Inventor: Owen R. Scholta, Burnsville, Minn.

[73] Assignee: Thorne Industries, Inc., Bloomington, Minn.

[21] Appl. No.: 19,869

[22] Filed: Mar. 12, 1979

[51] Int. Cl.[3] ..... G07F 15/12; G07F 17/06

[52] U.S. Cl. ..... 194/9 T; 222/3; 417/368

[58] Field of Search ..... 194/9 T, 1 R, DIG. 18, 194/3, 13; 222/3; 141/197; 152/415; 417/366, 368, 371

[56] References Cited

U.S. PATENT DOCUMENTS

| | | | |
|---|---|---|---|
| 1,156,078 | 10/1915 | Holden et al. | 194/82 |
| 1,187,031 | 6/1916 | Black et al. | 417/368 X |
| 2,010,062 | 8/1935 | Dawson | 137/227 X |
| 2,042,510 | 6/1936 | Cornelius et al. | 417/371 X |
| 2,228,894 | 1/1941 | Hayes | 194/9 T X |
| 3,191,801 | 6/1965 | Standish | 222/3 X |
| 3,208,574 | 9/1965 | Anson | 141/197 X |
| 3,761,203 | 9/1973 | Neidhardt et al. | 417/371 |

*Primary Examiner*—F. J. Bartuska
*Attorney, Agent, or Firm*—Burd, Bartz & Gutenkauf

[57] ABSTRACT

A coin operated vending machine operable to compress air and dispense compressed air for a selected period of time. The machine has an air compressor drivably connected to an electric motor. An air outlet hose attached to an on-off valve is connected to the air outlet of the air compressor. A housing surrounds the air compressor and motor to prevent unauthorized access thereto. The housing has a doorway closed with a locked door. A coin actuated control located within the housing has a switch and a timer operable to connect the motor to a power source for a selected period of time. A sequence counter connected to the control functions to count the number of times that the motor is connected to the power source.

8 Claims, 5 Drawing Figures

AIR COMPRESSOR AND DISPENSER

SUMMARY OF INVENTION

The invention is directed to an apparatus for compressing and dispensing compressed gas, such as air. More particularly, the invention is a coin actuated vending machine for delivering air under pressure for a predetermined period of time. The compressed air vending machine is usable in automobile service stations to provide the motor vehicle operator with a convenient and reliable source of air under pressure.

The vending machine has a security housing adapted to be secured to a support. The housing has a chamber and a doorway open to the chamber. Door means hinged to the housing closes the doorway to prevent unauthorized access into the chamber. The door means has lock means for holding the door in its closed position. Air pressure means located in the chamber is mounted on the housing. The air pressure means includes an electric motor and an air compressor means drivably connected to the motor. The air compressor means has air discharge means connected to an elongated flexible hose. A manually operated valve is connected to the remote end of the hose. The valve is attached to an air chuck used to connect the hose to an air receiver, such as a valve stem of a pneumatic tire.

The housing has an air inlet opening located adjacent the air pressure means whereby outside air flows to the air compressor means to cool the air compressor means and the motor. The air in the chamber is the source of the air to be compressed. A control means for the electric motor is located in the chamber. The control means includes switch means, timer means, and a coin operated actuator means to operate the timer means for a predetermined period of time. The switch means has a hand control knob adapted to be turned after the coin is inserted into a coin receiving slot. The control actuates the timer means which supplies electric power to the motor for a predetermined period of time; for example, five minutes. The motor drives the air compressor means to deliver air under pressure to the hose.

IN THE DRAWINGS

DESCRIPTION OF PREFERRED EMBODIMENT

Figure 1:
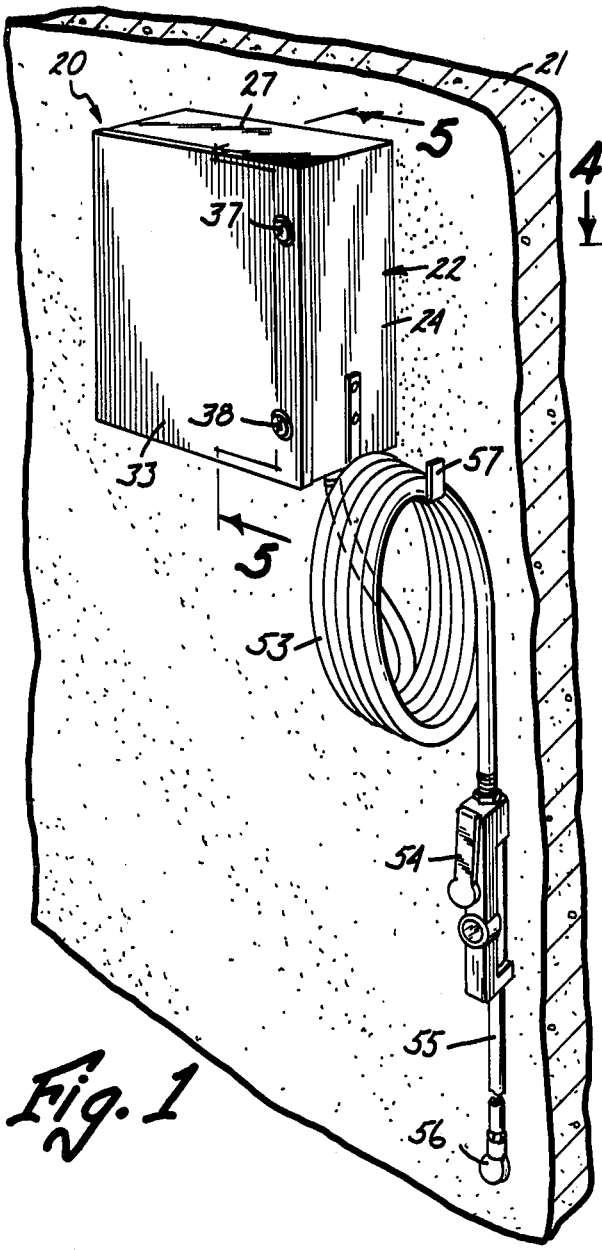
FIG. 1 is a perspective view of the gas compressing and dispensing apparatus mounted on a support.

Referring to FIG. 1, there is shown the gas compressing and dispensing apparatus of the invention indicated generally at 20 mounted on a secure support 21. Support 21 can be a side of a building or fixed post firmly anchored in the ground. Other types of supports and fixed structures can be used to carry apparatus 20. Apparatus 21 can be mounted on a portable structure, as a trailer or motor vehicle.

Figure 4:
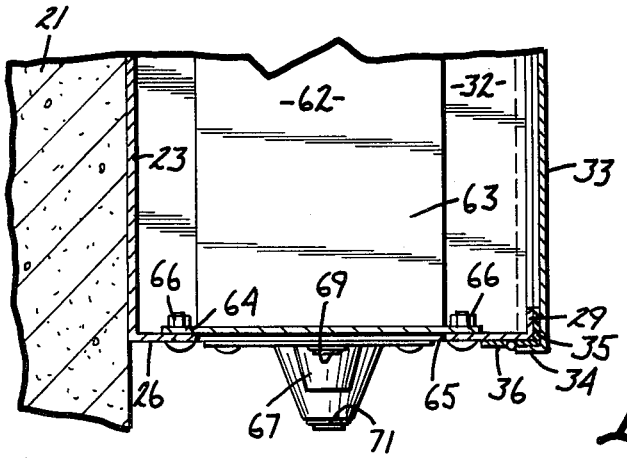
FIG. 4 is an enlarged fragmentary sectional view taken along the line 4—4 of FIG. 2.
Figure 3:
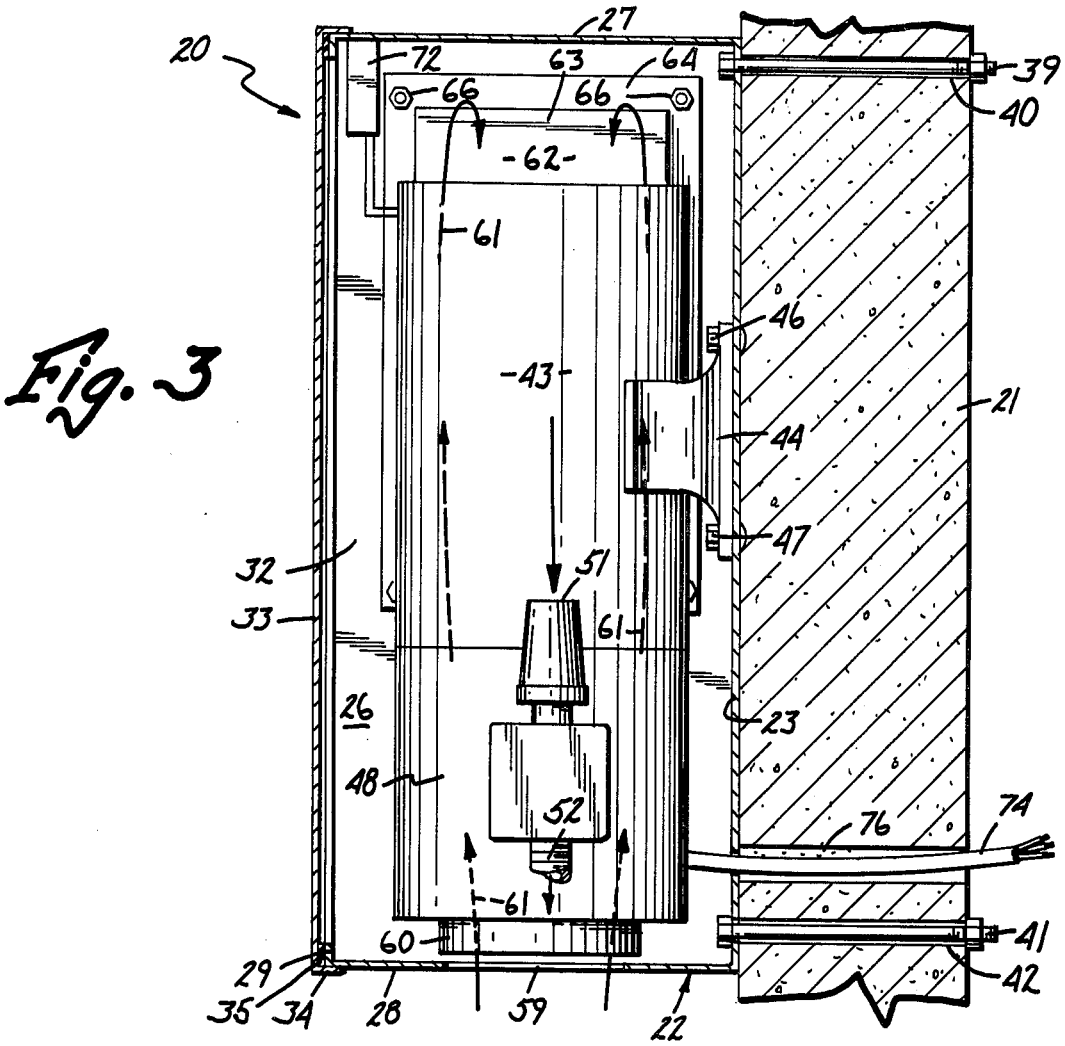
FIG. 3 is an enlarged sectional view taken along the line 3—3 of FIG. 1.

Apparatus 20 is operable to compress and dispense a gas. Preferably, the gas is air used to inflate air receivers or structures, such as pneumatic tires. Apparatus 20 has a boxlike housing indicated generally at 22. Housing 22 is made of strong structural material, such a metal, reinforced plastic, and like materials. Housing 22, as shown in FIGS. 3 and 4, has a generally flat back wall 23 joined to side walls 24 and 26. The top of housing 22 is closed with a top wall 27. A bottom wall 28 is joined to the bottom edges of the back and side walls 23, 24, and 26. Walls 23, 24, 26, 27 and 28 have an inwardly directed generally flat peripheral front flange 29 surrounding an opening or doorway 31 leading to an interior housing chamber 32.

Figure 5:
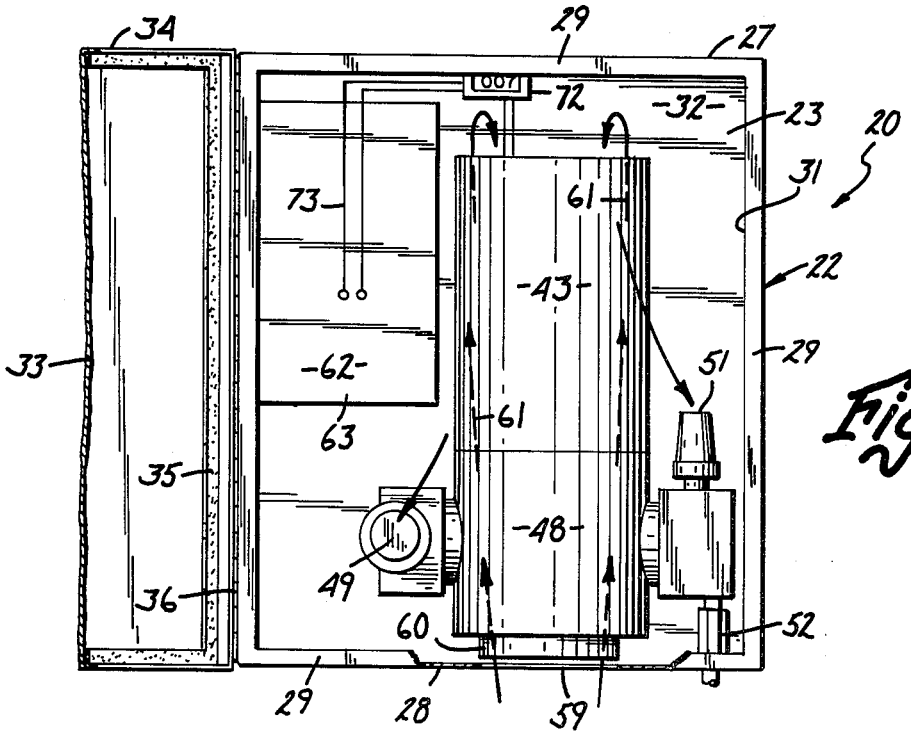
FIG. 5 is a front elevatonal view of the apparatus of FIG. 1 with the door open.

Doorway 31 is closed with a flat metal door 33. The outer peripheral edge of door 33 has an inwardly directed continuous flange 34. As shown in FIGS. 3 and 4, flange 34 fits over the outer edges of side walls 24 and 26, top wall 27, and bottom wall 28 and holds a continuous seal strip 35 in engagement with flange 29. An elongated upright piano hinge 36 movably mounts door 33 to side wall 26. Hinge 36 is attached by welds or like to side wall 26 in a manner so that it cannot be readily removed. A second portion of hinge 36 is secured to side flange 34 by welds or the like. Hinge 36 permits the door 33 to move about a generally upright axis to an open position, as shown in FIG. 5, exposing the interior chamber 32. Door 33 is secured in the closed position with a pair of key operated locks 37 and 38.

Housing 22 is attached to support 21 with upper bolts 39 extended through holes 40 in support 21. Lower bolts 41 extend through holes 42 in support 21 to attach the lower end of housing 22 to support 21. Other structures can be used to securely attach housing 22 to support 21 in a manner so that it cannot be readily removed. Preferably, a plurality of bolts, such as bolts 39 and 41, are used to attach housing 22 to support 21.

Figure 2:
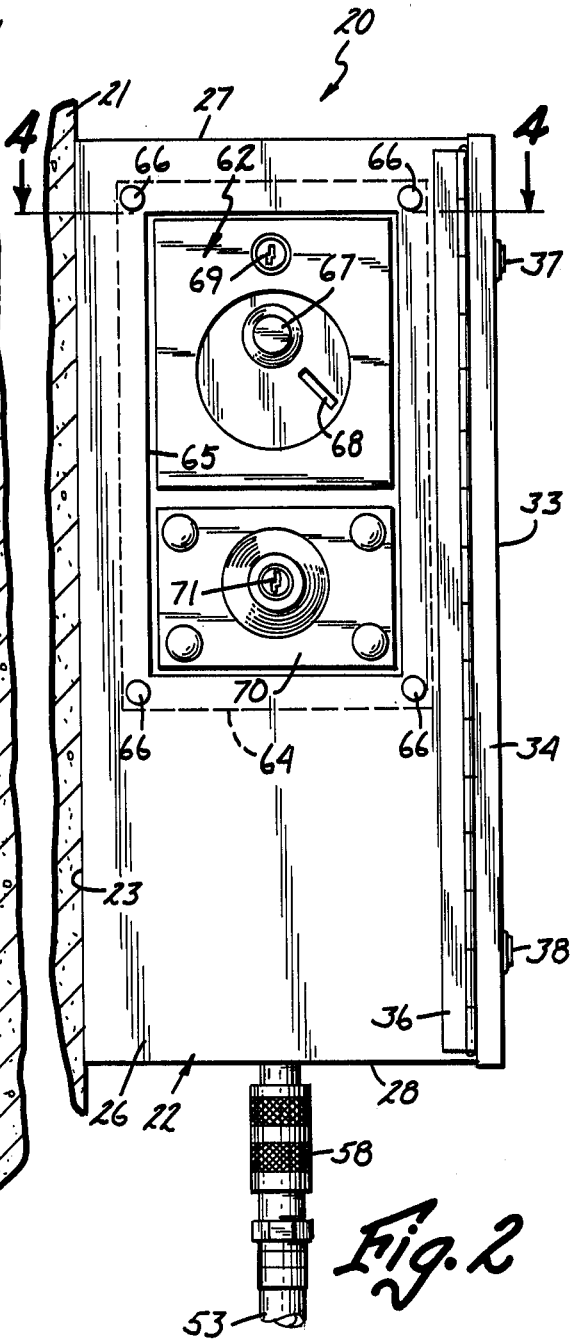
FIG. 2 is an enlarged elevational view of the left side of the apparatus of FIG. 1.

An air compressor means is located in chamber 32. Air compressor means in chamber 32 is drivably connected to an electric motor 43 supported on a mount 44. A plurality of nut and bolt assemblies 46 and 47 attach mount 44 to housing back wall 23. Motor 43 is supported in an upright position in the upper portion of chamber 32. An air or gas compressor indicated at 48 is attached to lower end of motor 43. Compressor 48 has a pair of gas intake means for gas to be compressed comprising air inlet structures 49 and 51 which have air filters which draw air from chamber 32 into compressor 48. The air is compressed by compressor 48 and discharged through an air outlet member 52 extended downwardly through a suitable hole in bottom wall 28. Outlet structure 52, as shown in FIG. 2, is connected to an elongated flexible conduit as an air hose 53 with a releasable coupling 58. Hose 53 has a remote end connected to a manually operated on-off valve 54. Valve 54 contains a pressure gauge and is connected to a short flexible hose 55. The outer end of hose 55 is attached to an air chuck 56. Chuck 56 can be an air chuck adapted to be coupled to a valve stem of a pneumatic tire whereby when valve 54 is moved to the on position, air is delivered to the pneumatic tire. A hose storage bracket 57, as shown in FIG. 1, is attached to housing side wall 24 to accommodate hose 53.

Returning to FIG. 5, bottom wall 28 has an opening 59 aligned with air compressor 48. Compressor 48 has a guide comprising a short downwardly directed sleeve 60 for directing air from opening 59 into compressor 48. Compressor 48 is axially aligned with motor 43. Motor 43 has a conventional rotor carrying air blades or vanes (not shown) operable to draw cooling air through the motor. The air moves through compressor 48 and motor 43 to cool both the compressor and the motor. The air is discharged from the upper end of motor 43 into housing chamber 32. The flow path of the air through the compressor 48 and motor 43 is indicated by arrows 61.

Motor 43 is operated a predetermined period of time by coin operated control means indicated generally at 62. Control means 62 has a timer and switch box 63 mounted on side wall 26. As shown in FIG. 4, switch box 63 has an inside peripheral flange 64 attached to the inside of wall 26 with a plurality of nut and bolt assemblies 66. Box 63 has a front plate which fits into an opening 65 in side wall 26 to inhibit unauthorized removal of the control means and coin receiving box 70. Control box 63 has an external hand operated actuator 67. Actuator 67 includes a coin slot 68 for accommodating an actuating coin. Actuator 67 and disc having coin slot 68 can be a combined control knob and escutcheon as disclosed in U.S. Patent Des. 188,391. The coin functions to actuate the timer and switch to connect motor 43 to a power source for a predetermined period of time; for example, five minutes. The switch and timer structure is locked on box 63 with a lock 69. The coin receiving box 70 is located below the timing and switching controls in box 63. A lock 71 secures the coin box 70 to box 63. Suitable keys are used to unlock the locks 69 and 71 so that the timing and switching controls and coin box 70 can be removed from the dispensing apparatus.

As shown in FIG. 5, a sequence counter 72 is attached to top wall 27. Electric lines 73 attach counter 72 to control box 63 and motor 43. A power input line 74 extends through a passage 76 in support 21 to connect the control box 63 to an outside source of power, such as the conventional A.C. power.

An example of the machine for vending compressed gas is as follows. Housing 22 is a box shaped heavy gauge metal structure having a width of 14 inches (35.5 cm) and a vertical height of 16 inches (40.6 cm). Housing 22 has a depth of 8 inches (20 cm). Door 33 is a flat heavy metal plate that covers the forward side of housing 22 and is pivotally attached thereto with a heavy piano hinge 36. A pair of key operated locks 37 and 38 secure door 33 in a locked position closing the open side of housing 33. Housing 33 has top and bottom walls 27 and 28 and side walls 24 and 26 to form a rectangular shape box. The back wall 23 of the housing accommodates a plurality of fasteners used to secure the housing to a fixed support. The forward side of housing 33 is open. Each of the walls 24, 26, 27, and 28, has an inwardly directed flange 29. Door 33 has a rearwardly directed continuous flange 34 that fits over the outer portion of the side walls, top wall, and bottom wall. A resilient rectangular sealing strip 35 extends around the cover and engages the inwardly directed flange 29 of the housing when door 33 is in the closed position.

Air compressor means 48 is rotating vane type pump. The pump is mounted directly to an electric motor 43. The pump has 100 psi gauge maximum capacity. The pump has two inlet air filters 49 and 51 and supports an outlet coupling 52. The outlet coupling extends through a hole in the bottom wall 28 and is adapted to be releasably connected to an air line or hose 53.

Bottom wall 28 has a central opening 59 in general axial alignment with the inlet of the pump. Outside air moves through opening 59 in bottom wall 28 and into the inside of the pump. The air moves through the pump to cool the pump and through the electric motor to cool the electric motor. The air is discharged from the top of the electric motor 43 into housing chamber 32.

Electric motor 43 is an A.C. electric motor $\frac{1}{3}$ horsepower that runs at 1725 rpm. Other types of motors can be used to operate air compressor means 48.

Secured to housing wall 26 is a coin-operated control 62 functional with a 25¢ U.S. Coin Control 62 is a coin-operated unit having timer means and switch means which is actuated to an "on" condition a predetermined period of time by the timer means. A coin and rotation of actuator 67 starts the timer means and activates switch means to connect electric power to motor 43. Control 62 is a commercial unit manufactured by Greenwald Industries, Inc., Brooklyn, N.Y. 11237. Control box 63 has a generally box rectangularly shape of 5×6×4 inches and is located below the switch means to receive and store coins.

A cycle counter 72 is mounted on top wall 27. Electrical lines 73 electrically couple the control box 63 to unit 72 so that every time that motor is operated the counter will advance. The counter 72 is an electrical counter unit having a numerical read out, as counter model 2-1525 made by Redington Counter, Inc., Windsor, Connecticut, U.S.A.

The compressing and dispensing apparatus has been described with specific structures and operating components. Changes in the structures, materials, size of components can be made without departing from the invention. The invention is defined in the following Claims.

I claim:

1. An apparatus for compressing and dispensing compressed gas comprising:

a housing adapted to be secured to a support, said housing having a chamber, a doorway open to the chamber, door means movably mounted on the housing for closing the doorway, lock means cooperating with the door means for holding the door means in a closed position covering the doorway, holding the door means in a closed position covering the doorway, an electric motor located in the housing chamber, means mounting the motor on the housing, gas compressor means located in the chamber and drivably connected to the motor, said gas compressor means and said motor having communicating passages therethrough for directing cooling gas into proximity to said gas compressor means and said motor, said gas compressor means having a guide for directing gas into said passages of the compressor means, and also having intake means for gas to be compressed open to said chamber, said housing having a bottom wall, a gas inlet opening in said bottom wall located adjacent the guide for directing gas into the gas compressor means, said motor having gas impelling means for carrying cooling gas from the guide through the gas compressor and motor and discharging the gas therefrom into said chamber, said gas in the chamber being drawn into the gas intake means on operation of said gas compressor means, conduit means connected to the gas compressor means to carry compressed gas to a desired location externally of said housing, control means located in the housing chamber operable to connect the motor to an electric power source whereby the motor operates the gas compressor means to compress gas and deliver gas to the desired location, said control means including switch means and coin operated timer means to operate the switch means a limited period of time in response to actuation of the timer means with a coin, and means mounting the control means on the housing.

2. The apparatus of claim 1 wherein: the conduit means connected to the gas compressor means includes an elongated hose, on-off valve means connected to the hose, and a gas chuck connected to the valve means adapted to accommodate a gas valve stem of a pneumatic tire.

3. The apparatus of claim 1 including: means mounting the gas compressor means on the motor.

4. The apparatus of claim 1 wherein: the housing has a back wall adapted to be secured to a support, said means mounting the motor on the housing including means attaching the motor to the back wall.

5. The apparatus of claim 1 including: counter means located within the chamber cooperatively associated with said motor for counting the number of times that the motor is connected to the source of electric power.

6. The apparatus of claim 1 including: hinge means secured to one side of the door means to pivotally mount the door means on the housing, said lock means being located on the opposite side of the door means.

7. The apparatus of claim 1 wherein said guide includes sleeve means carried by said compressor means and extending towards said housing bottom wall and into proximity to said wall gas inlet opening thereby to direct gas from said inlet opening through said sleeve means toward said passages of compressor means and motor.

8. The apparatus of claim 7 wherein said housing bottom wall gas inlet opening constitutes the only significant open access to said housing chamber when said door means is in closed, position, and said sleeve means is in closely spaced relation to said housing opening, thereby to preclude unauthorized access to said housing chamber.

* * * * *